US005575114A

United States Patent [19]

Riegelman

[11] Patent Number: 5,575,114

[45] Date of Patent: Nov. 19, 1996

[54] HOPPER WINDOW

[76] Inventor: Harry M. Riegelman, 2417 Wimbledon, Arlington, Tex. 76017

[21] Appl. No.: 512,004

[22] Filed: Aug. 7, 1995

[51] Int. Cl.[6] ..... E05D 15/28

[52] U.S. Cl. ..... 49/246; 49/250

[58] Field of Search ..... 49/246, 250, 251, 49/260, 261

[56] References Cited

U.S. PATENT DOCUMENTS

| | | | |
|---|---|---|---|
| 1,388,121 | 8/1921 | Porter . | |
| 1,696,607 | 12/1928 | Hysert . | |
| 1,760,072 | 5/1930 | Lea . | |
| 1,832,058 | 11/1931 | Stewart . | |
| 1,919,371 | 7/1933 | Klemm . | |
| 2,027,240 | 1/1936 | Looney | 20/49 |
| 2,266,076 | 12/1941 | Reynolds | 20/49 |
| 2,796,639 | 6/1957 | Reynolds | 20/49 |

*Primary Examiner*—Kenneth J. Dorner
*Assistant Examiner*—Curtis A. Cohen
*Attorney, Agent, or Firm*—Robert A. Seemann

[57] ABSTRACT

A sash of a hopper window is linked to a shoe which engages a track in constant resistance to travel along the track such that the sash can be tilted by hand to any angle from the track within a predetermined range of angles, and will remain at the angle unaided.

12 Claims, 8 Drawing Sheets

HOPPER WINDOW

BACKGROUND OF THE INVENTION

1. Field of the Invention

This invention pertains to hopper windows, more specifically to a window assembly which is usually cast in a concrete cellar foundation wall, in which the window is opened by tilting the window sash out of the window frame, inwardly toward the cellar.

2. Description of the Prior Art

During construction of a building, when concrete is being poured for a cellar wall, the cellar window is often cast into the concrete wall. It is desirous to be able to cast the window frame in the concrete without the sash, in order to avoid damage to the window glass.

After the concrete foundation is completed, it is desirable to use the window opening to pass construction materials and tools to and from the interior of the building without damage to, or interference from, the sash and associated tilt mechanism.

Fully installed hopper windows often are difficult to set to a variety of angles of tilt, and are difficult to clean on both sides of the window pane from the inside of the cellar.

The window is subject to dampness, sand and grime, and is used intermittently with relatively long periods of inactivity. This makes complicated continuously adjustable and settable tilt mechanisms impractical.

The prior art is replete with tilt window designs in which the sash may be set to various angles. U.S. Pat. No. 1,388,121, patented Aug. 16, 1921, by H. P. Porter, discloses a tilt-in window sash, the bottom end of which is pivotally attached by pull-out pins, or locking bolts, to a pair of vertical supports of a frame that holds the window sash.

A folding linkage is pivotally attached by a permanent bracket or keeper to the sash a short distance from the top of the sash, and is pivotally attached by a pivot pin and locking latch to a keeper on one of the supports at about the same height. The keeper is pivoted like scissors, at its center.

The arms of the scissors are brought together one over the other when the window sash is closed, that is, when it is parallel with the supports.

When the window sash is drawn from the top of the sash by hand, out of the frame to the limit of inward tilt set by the spread of the arms, the arms are opened to an obtuse, almost straight angle.

The folding linkage sets the limit of inward tilt by engaging cam edges on the linkage arms with flanges on the attachment brackets or keepers as the arms approach 180 degrees separation from one another.

The window sash can be tilted to any one of a plurality of predetermined positions, between closed and the limit of inward tilt, where it is held in the selected position by spring-biased interlocking corrugations and ribs on the arms at the scissor pivot.

The window sash can be freed for removal from the frame by pulling out the locking bolt at the bottom of the window sash and opening the locking latch on the pivot pin of the keeper on the support.

U.S. Pat. No. 1,696,607, patented Dec. 25, 1928, by R. W. Hysert, discloses a window which includes two vertical parallel supports preferably stamped from sheet metal.

Each support has two independent slots which are a uniform, longitudinal slot or sash guide-way at one end of the support, and a keyway shaped longitudinal slot or brace guide-way at the other end of the support.

In one design the two slots are stamped in a single metal sheet which forms the support. In another design, a metal sheet is formed with a longitudinal channel, and contains a riveted stop about midway of the support. A portion of the channel to one side of the stop is the sash guide-way. A second sheet of metal with a stamped in keyway shaped brace guide-way is brazed into the channel on the other side of the stop.

A window sash arranged between the supports is pivotally attached to the supports by pivots which extend laterally from the bottom end of the window sash into the sash guide-ways.

On each side of the sash, a straight brace is pivotally attached at one end to the sash, and at the other end has a pin that extends into the brace guide-way of the adjacent support. The pin is held in the brace guide-way by a head on the pin that locates behind a lateral wall of the brace guide-way. The pin and head are installed and removed from the brace guide-way by way of the wider opening at the top of the guide-way provided by the keyway shape.

The window sash is opened by pulling the top of the sash out from between the supports. The sash falls to an angle from the supports that is permitted by the length of the brace between the bottom of the brace guide-way to which it falls in the brace guide-way, and the pivotal attachment of the brace to the window sash. This is the first open position of the window sash.

A second, more open position is obtained by further drawing the top of the window sash downward in an arc whereby the window sash pivots on the pivotal attachment of the brace to the window sash and the pivot at the bottom of the window sash moves upward in the sash guide-way to the upper end of the guide-way.

U.S. Pat. No. 1,760,072, patented May 27, 1930 by W. C. Lea, discloses a sash attached to a pair of supports by a link bar which is pivotally attached to the side of the sash about midway between the top and bottom of the sash, and pivotally attached to a bracket which is screwed to one end of the support. The support has a track which extends from the bracket to the other end of the support.

One end of the sash has a sliding member which rides in the track. A tapered screw on the sliding member spreadingly engages a pair of movable rods, the outer surfaces of which engage friction members that bear against the track increasingly as the screw is extended between the rods.

Either front or back face of the sash can be made to face inward to a room, by sliding the end of the sash having the sliding member, through a normal taken from the pivot attachment on the side of the sash, to the track.

U.S. Pat. No. 1,919,371, patented Jul. 25, 1933 by W. J. Klemm, discloses a window sash pivoted at the bottom end in a pair of bearing assemblies which slide in vertical tracks, one on each side of the sash.

An arm which is pivotally attached by a first end to the window sash at about the center of the sash is pivotally attached by the second end to a slider which moves in the track. The slider has a wedge projection.

When the window is closed, the sash can be reciprocated vertically in the track. At the start of angling the sash out of the track, the slider moves down, forcing the wedge projection between legs of a cam brake that cams outward into the sides of the track preventing further vertical downward movement of the slider and preventing vertical reciprocation of the window. The window sash then rotates about the pivot at the first end of the arm as it angles further away from the tracks and the bottom end of the sash slides up in the track until it comes up against an abutment formed in the sheet metal of the track, which stops further rotation of the sash.

SUMMARY OF THE INVENTION

It is one object of the invention to provide a hopper window in which the sash can be tilted out of the window frame to any angle between the window's closed position and a predetermined angle.

It is another object that the sash can be tilted to any angle between the window's closed position and a predetermined angle, and that it will remain at that any angle without further adjustment or outside assistance.

It is another object that the predetermined angle can be changed to a new predetermined angle.

It is another object that the sash can be easily and quickly removed from and installed in the window frame.

It is another object that installation and removal of the sash can be done without tools.

It is another object that the adjustment mechanism of the window is not easily affected by sand and other cellar type contamination.

It is another object that moving parts of the window are removed from the window frame when the sash is removed.

It is another object that a significant portion of the window can be made from extruded plastic.

It is another object that the window mechanism is simple and inexpensive to make.

Other objects and advantages will be readily apparent from the ensuing description.

A hopper window includes in combination, a frame and a sash, the frame including a pair of parallel extruded jambs. One jamb includes a track having a first end, a second end, and stop means mounted on the track between the first end and the second end.

The sash includes pivot means extending from a second end of the sash into the track between the stop means and the second end of the track. An arm pivotally attached at one end to the sash between the first end of the sash and the second end of the sash is attached to a shoe means on the other end of the arm.

The shoe means is slidably mounted on the track for travel along the track between the first end of the track and the stop means.

The shoe means engages the track in generally constant resistance to travel along the track such that the sash can be drawn by hand against the generally constant resistance, to any angle from the track set by the location of the shoe in the track between the first end of the track and the stop means, and the sash is held at the aforesaid any angle by the generally constant resistance to travel of the engaging.

The track includes a pair of longitudinal flanges and a longitudinal back wall, the shoe means being slidably mounted between the flanges and the back wall, and being attached to the arm between the flanges.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
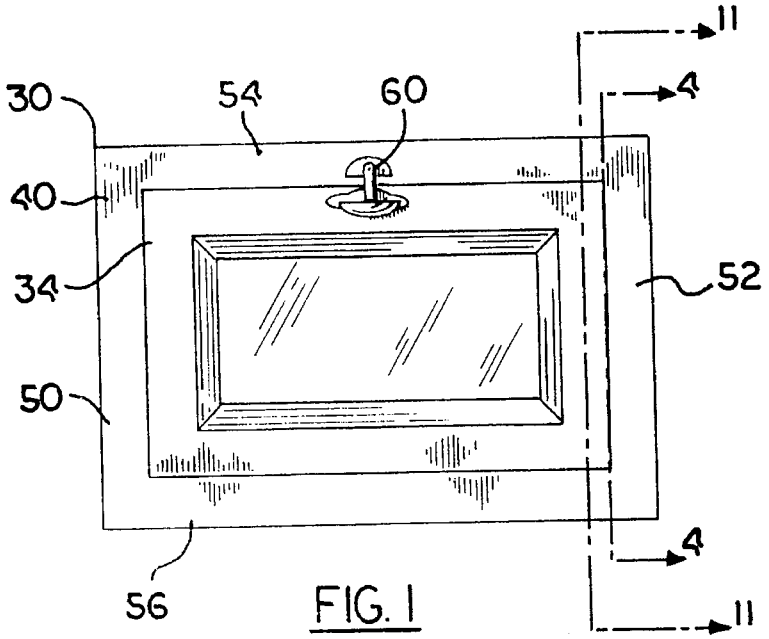
FIG.1 is a front view of a hopper window of the present invention.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

In FIG. 1, hopper window 30 is closed. Window sash 34 is fully seated in window frame 40, generally parallel with jambs 50, 52, head 54, and sill 56. Latch 60 is closed.

The invention is described herein with reference to jamb 52. It will be understood that the relationship between sash 34 and jamb 50 is about the same as it is between the sash and jamb 52.

Figure 2:
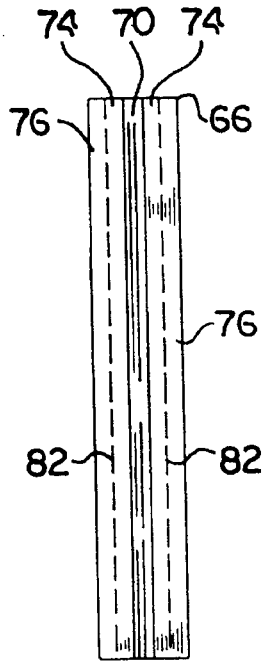
FIG. 2 is a side view of extruded stock for the window frame of the hopper window of FIG. 1.

Referring to FIG. 2, stock 66, extruded from rigid exterior grade polyvinylchloride, is used to make the head, sill and jambs. It includes track 70 which is shown in end view at the top of FIG. 4.

Figure 3:
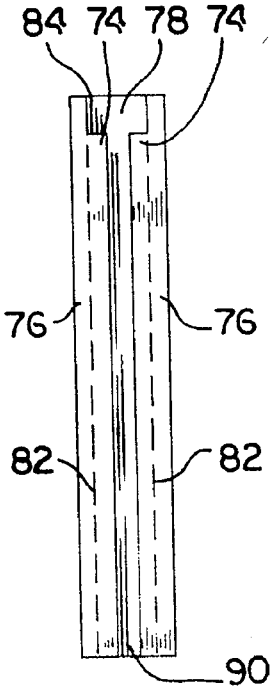
FIG. 3 is a side view of a portion of the extruded stock of FIG. 2, prepared to be a vertical jamb in a frame assembly.

In FIG. 3, one end of each jamb is prepared prior to assembly of the frame, by removing portions of inward extending flanges 74 to form a lateral opening 78 in track 70. Flanges 74 extend from side walls 76.

Phantom lines 82 which are used to show side walls 76 in the jambs are included in FIGS. 1–7, and dropped from other figures so as not to obscure other features under discussion.

Figure 4:
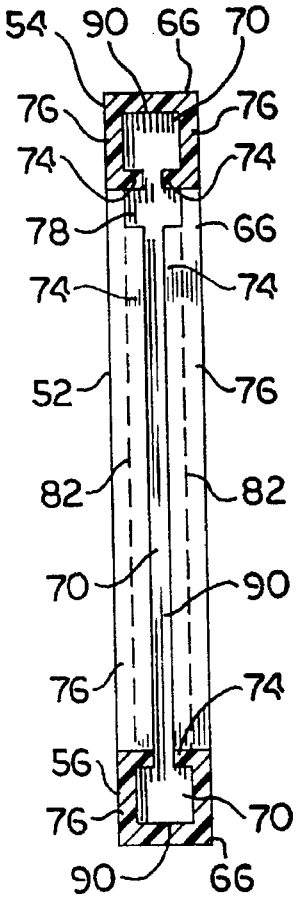
FIG. 4 is a section view of the window of FIG. 1 as viewed in a side view, along 4–4.

Referring to FIG. 4, stock 66 sections which comprise head 54, jambs 50, 52, and sill 56, are fastened together by screws, or by welding, cement, or other permanent means to make frame 40, without concern about later insertion of sash 34 in the frame because all attachment and sliding hardware for mounting the sash in the frame is exclusively part of the sash. The assembled frame has a pair of the continuous extruded tracks 70, one in each jamb for operation of the sash as will be explained later. The continuous tracks 70 in the head and sill are a by-product of the assembly, and contribute to a saving in costs by using common stock.

Figure 5:
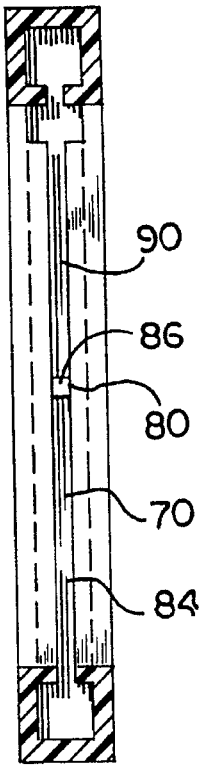
FIG. 5 is the assembly of FIG. 4, with a stop means attached to a track of a vertical jamb.

Removable stop 80 in FIG. 5 is inserted into track 70 and screwed or otherwise reversibly fastened to back wall 84 of the jamb which happens to be the back wall 90 of the track. Stop 80 may be moved to another location along the track in order to adjust operation of the sash as will be explained later. Track 70 is uniform adjacent to either side of stop 80 regardless of the selected location of stop 80, in this element of extruded stock.

Figure 6:
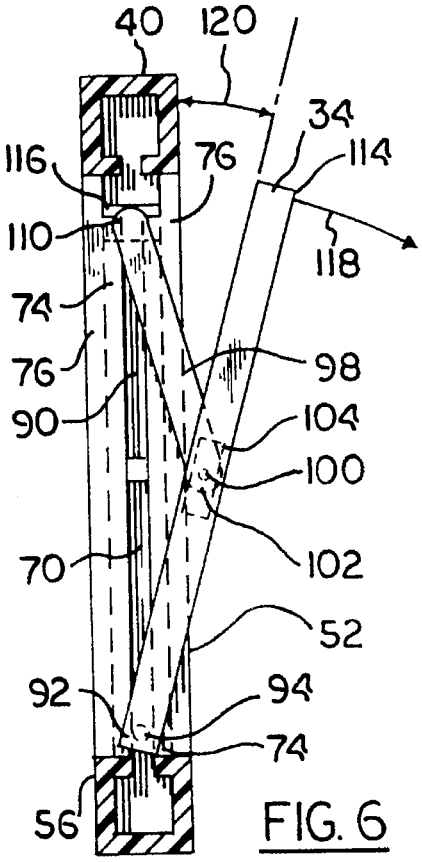
FIG. 6 is a side view of the assembly of FIG. 5, with an installed sash tilted from the track of the vertical jamb.

In FIG. 6, sash 34 is installed in frame 40, and is extended at an acute angle 120 from the track by being drawn from the track by end 114 of sash 34 in direction 118.

At end 92 of the sash, pivot pin 94 extends laterally into track 70 of adjacent jamb 52. Arm 98 is attached at end 102 to sash 34 by pivot rivet 100 of bracket 104.

Shoe 116, attached to end 110 of arm 98, is slidingly mounted in track 70. The shoe is confined in the longitudinal cavity that extends the length of the track and is bounded by side walls 76, back wall 90, and flanges 74.

Sash 34 is at shallow angle of extension 120 from the track. End 92 of the sash rests on sill 56.

Figure 7:
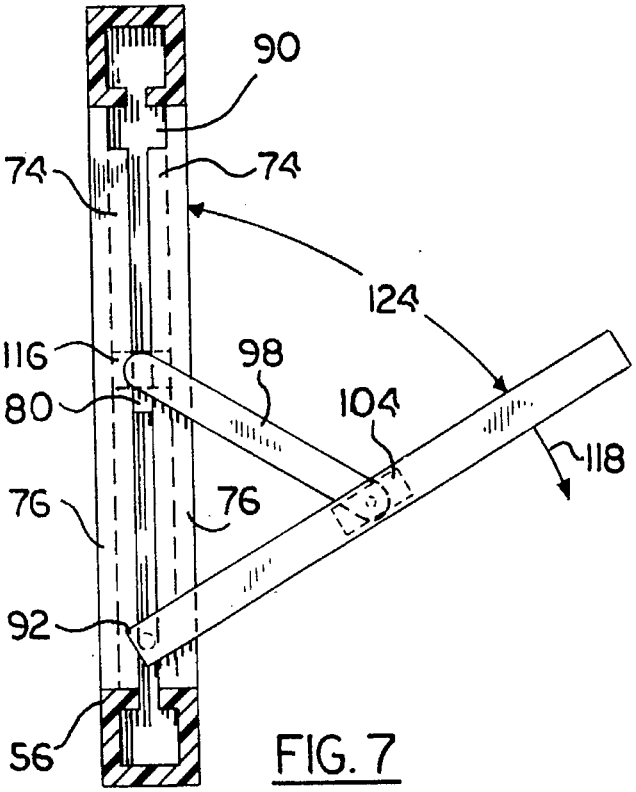
FIG. 7 is a side view of the assembly of FIG. 5, with an installed sash tilted from the track of the vertical jamb.

In FIG. 7, as sash 34 is drawn 118 from the track, shoe 116 slides down in track 70 until it runs into stop 80. Arm 98 limits the distance that bracket 104 can move from the track. End 92 of the sash continues to rest on sill 56 due to the weight of the sash. Sash 34 is at a first stage angle of maximum extension 124.

Figure 8:
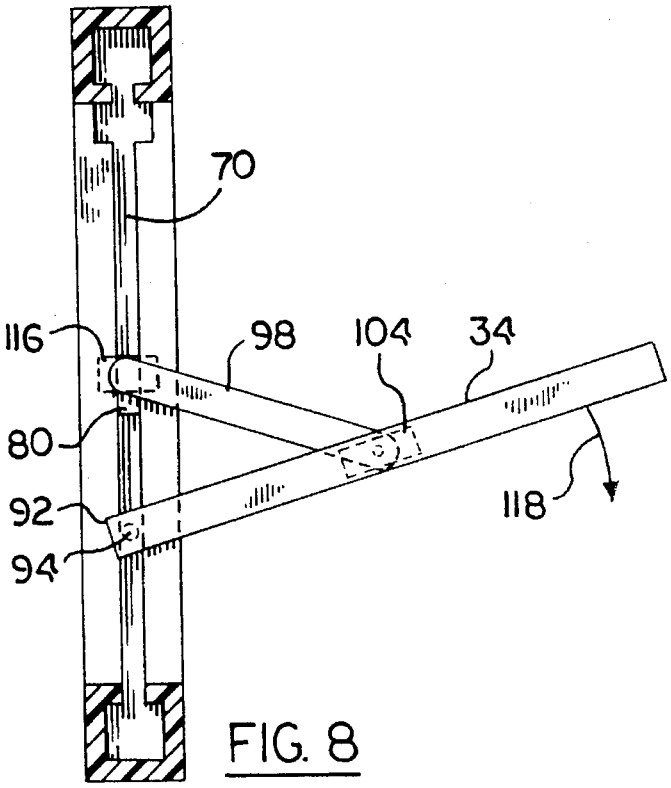
FIG. 8 is a side view of the assembly of FIG. 5, with an installed sash tilted from the track of the vertical jamb.
Figure 9:
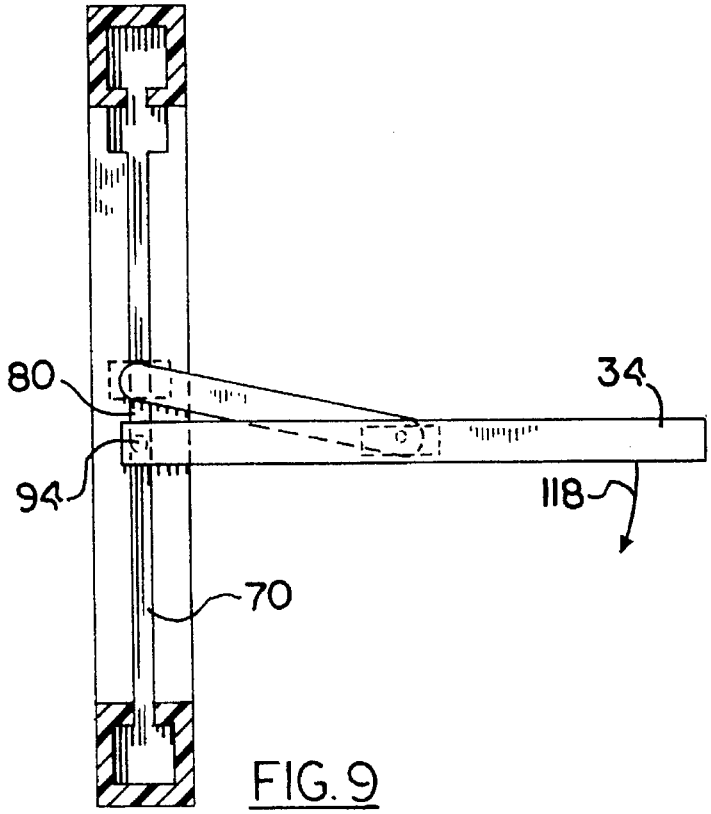
FIG. 9 is a side view of the assembly of FIG. 5, with an installed sash tilted from the track of the vertical jamb.

In FIG. 8, as sash 34 is drawn 118 further from the track, shoe 116 within track 70 comes against stop 80 with no where to go, arm 98 prevents further movement of bracket 104 away from the track, and end 92 of the sash rises as pivot pin 94 moves upward in track 70 until, as shown in FIG. 9, the upward movement of end 92 is stopped by stop 80, and sash 34 is almost perpendicular to track 70. Sash 34 is at a second stage angle of maximum extension.

The range of stage 1 angle of maximum extension is predetermined by the location of stop 80 in the track, and is changed to a new predetermined angle of maximum extension by setting the stop at a new location in the track.

Figure 10:
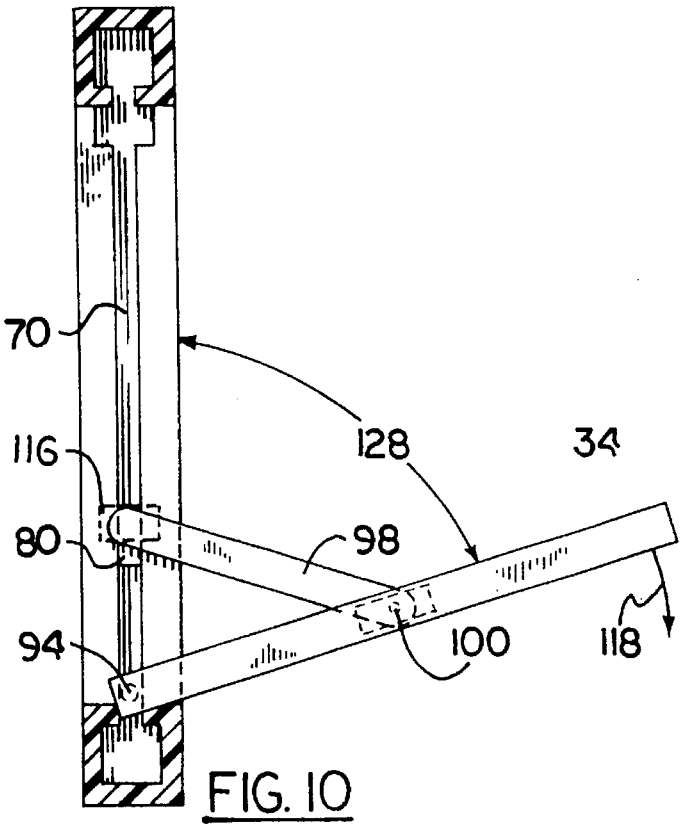
FIG. 10 is a side view of the assembly of FIG. 5, with the stop means relocated to another position in the track, and with an installed sash tilted from the track of the vertical jamb.

In FIG. 10, stop 80 is attached lower in track 70. This establishes a new angular limit 128 for the first stage angle of maximum extension. The second stage angle of maximum extension is predetermined by the length of arm 98, the location of pivot rivet 100 on sash 34, or the length of sash between pivot rivet 100 and pivot 94, and how close pivot 94 can get to shoe 116 in track 70.

Figure 11:
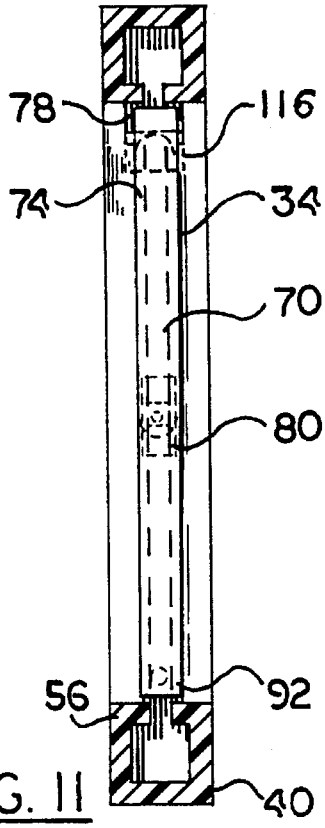
FIG. 11 is side view of the assembly of FIG. 5, with an installed sash in the window-closed position.

In FIG. 11, sash 34 is fully seated in frame 40, parallel with track 70. End 92 of the sash is resting on sill 56. In this configuration, shoe 116 is held by flanges 74 in track 70, slightly below lateral opening 78.

Figure 12:
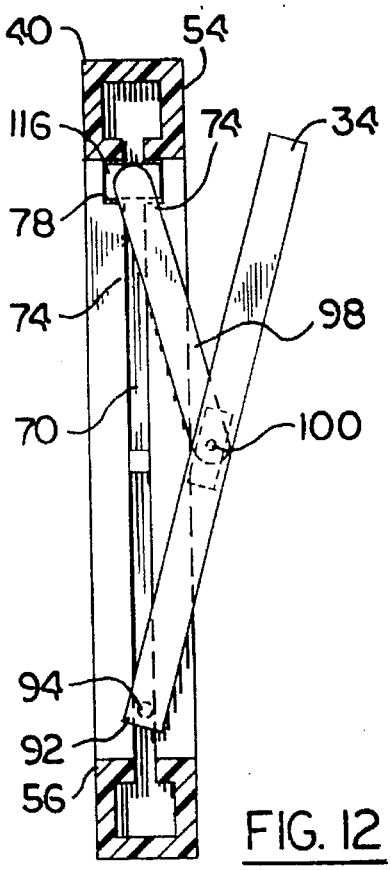
FIG. 12 is a side view of the assembly of FIG. 5, with an installed sash positioned for removal of a shoe from the track.
Figure 13:
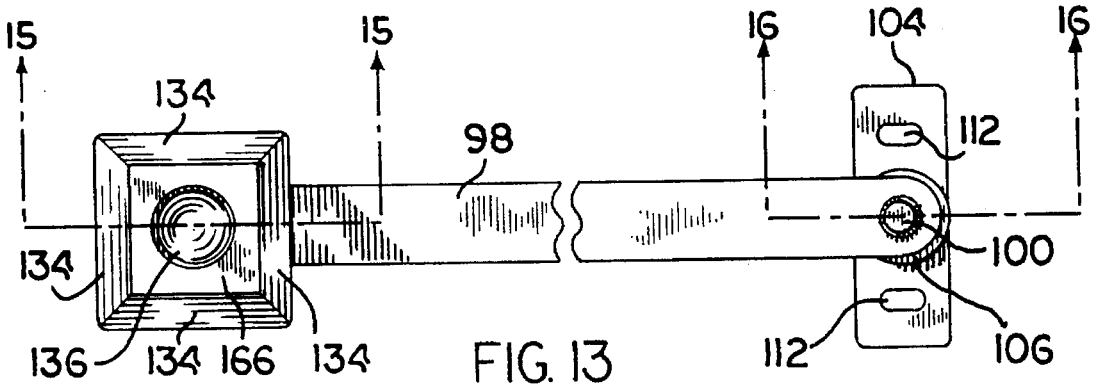
FIG. 13 is a bottom view of an arm with shoe and bracket, of the invention.
Figure 14:
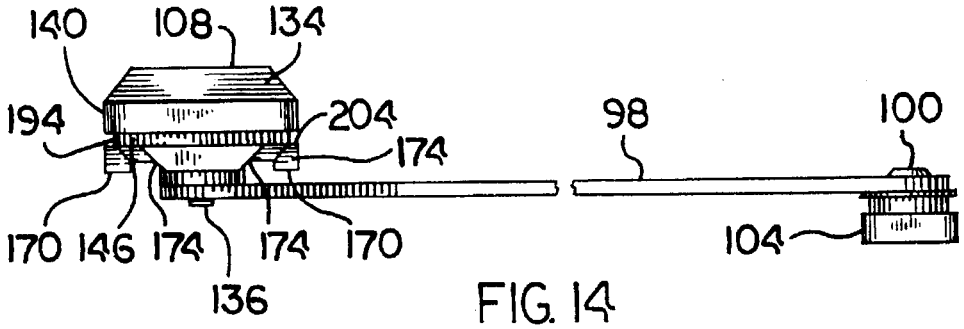
FIG. 14 is a side view of the arm with shoe and bracket, of FIG. 13.
Figure 15:
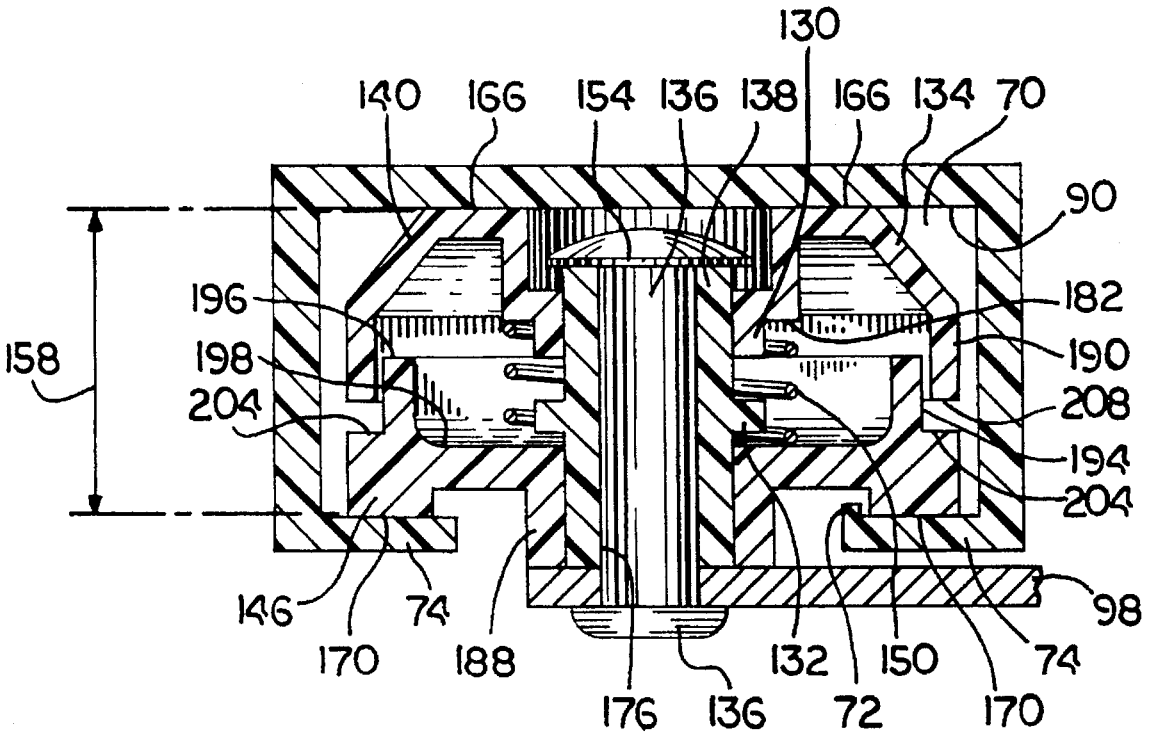
FIG. 15 is a cross section view of the shoe of FIG. 13, taken along 15—15. The shoe is captured within a track that is not shown in FIG. 13.
Figure 16:
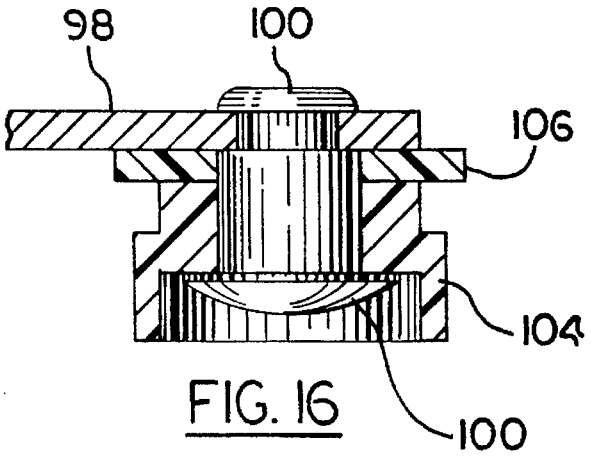
FIG. 16 is a cross section view of the bracket of FIG. 13, taken along 16—16.
Figure 17:
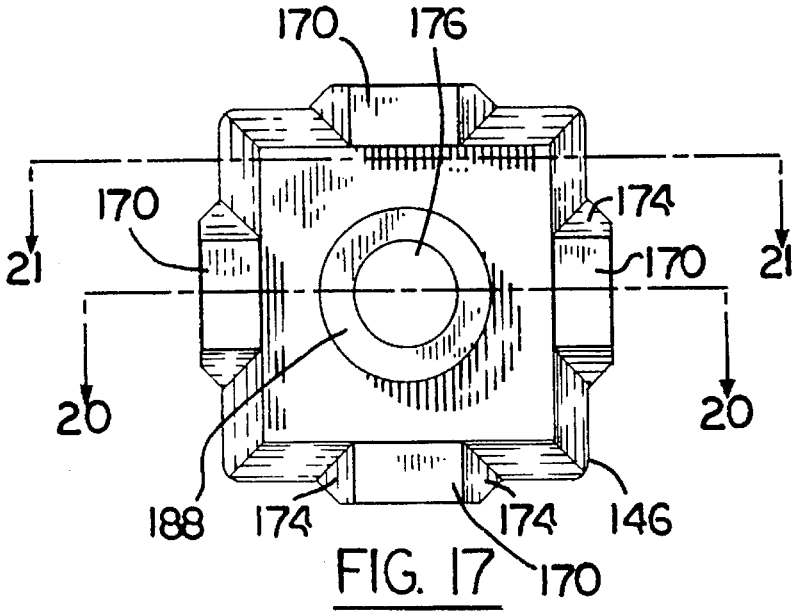
FIG. 17 is a top view of an inner friction head of the shoe of FIG. 15.
Figure 18:
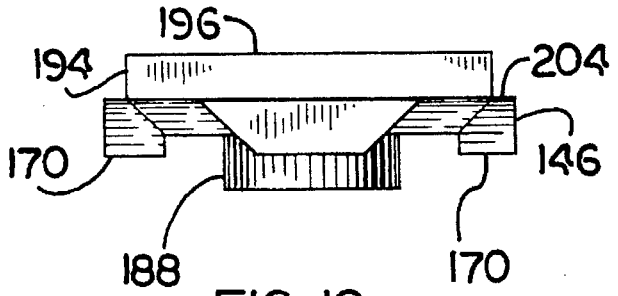
FIG. 18 is a side view of the inner friction head of FIG. 17.
Figure 19:
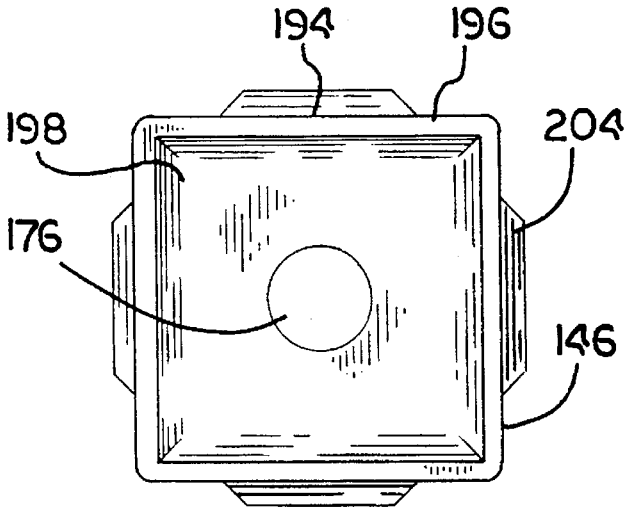
FIG. 19 is a bottom view of the inner friction head of FIG. 17.
Figure 20:
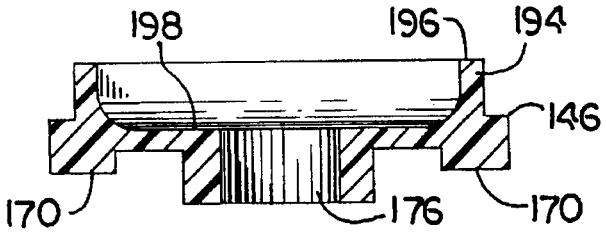
FIG. 20 is a cross section view of the inner friction head of FIG. 17, taken along 20—20
Figure 21:
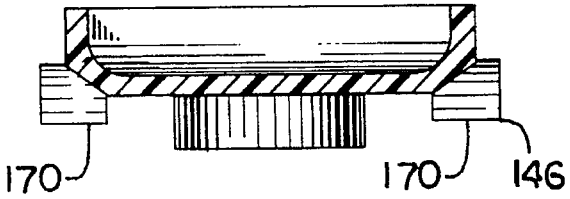
FIG. 21 is a cross section view of the inner friction head of FIG. 17, taken along 21—21.
Figure 22:
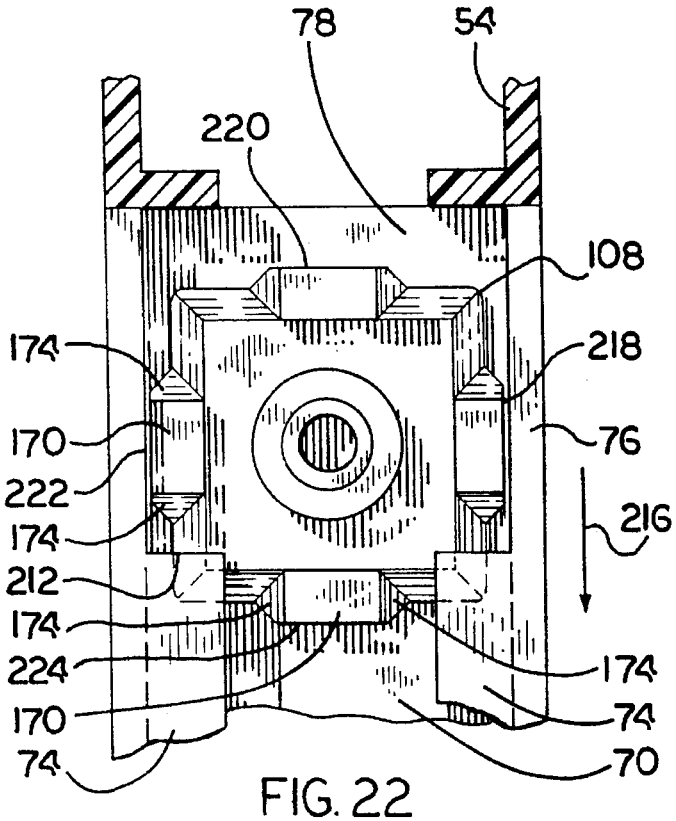
FIG. 22 is a top view of the shoe of FIG. 13 being installed in a track. An arm and a rivet are removed for clarity of the drawing.
Figure 23:
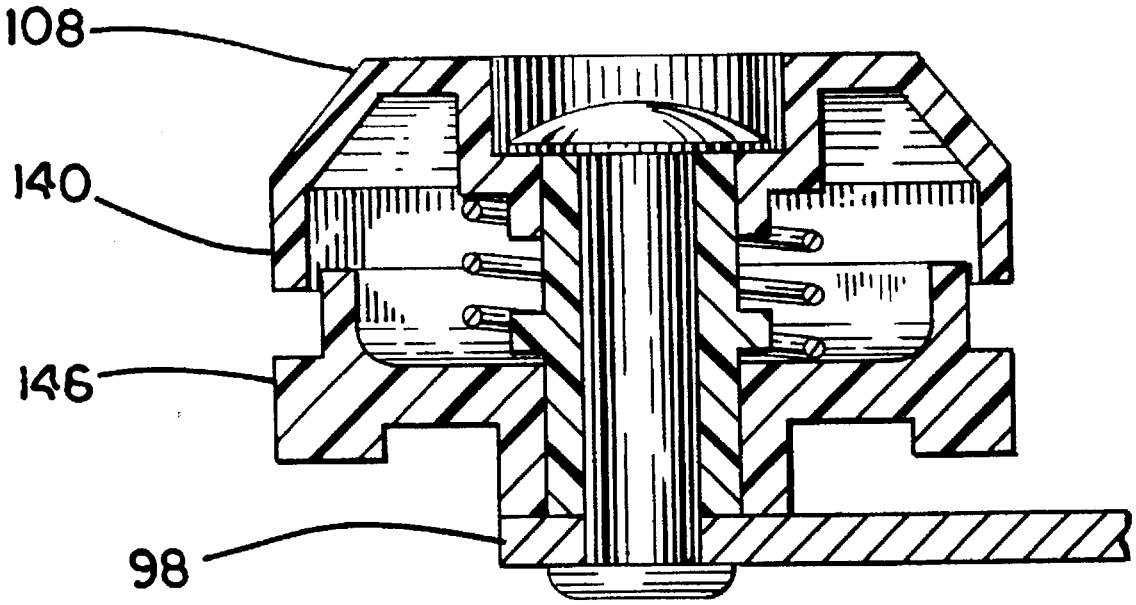
FIG. 23 is a cross section view of the shoe of FIG. 13, taken along line 15—15.

In FIG. 12, sash 34 is positioned for removal of the sash from frame 40. End 92 of the sash is hand displaced upward from sill 56. Sash 34 is extended at an acute angle from track 70, the acute angle being adjusted so that shoe 116 is in lateral opening 78 clear of flanges 74 so that the shoe can be pulled laterally away from the jamb out of opening 78. Once the shoe is free from the track, enough lateral play is provided in pivot rivet 100 and flexibility in arm 98 to permit rotation of arm 98 upon pivot rivet 100, out of frame 40. End 92 of sash 34 is removed from the frame by angling the sash from the track toward the perpendicular to the track, then tilting one side of the sash so that there is differential movement between pivot pins 94 in jambs 50 and 52, until the pins come out of the tracks in jambs 50 and 52.

Referring now to FIGS. 13–15, 22, and 23, chamfers 134 ease the way for entry of shoe 108 into a lateral opening of a jamb. Shoe 108 can rotate on arm 98 about rivet 136. Arm 98 can rotate on bracket 104 about pivot rivet 100. Washer 106 prevents rotational interference between arm 98 and bracket 104. Holes 112 are provided for attaching bracket 104 to the sash.

Shoe 108 comprises an outer friction shoe 140 and an inner friction shoe 146. Outer friction shoe 140 and inner friction shoe 146 are biased apart by spring 150 which bears against shoe 140 thrust face 182 and shoe 146 thrust face 198. Shoe 108 is compressed in FIG. 15, and relaxed in FIG. 23. The limit of maximum expansion 158 between shoes 140 and 146 is set by the length of rivet 136. The limit of maximum expansion is greater than the distance between flanges 74 and back wall 90 of track 70 so that friction wall 166 presses against back wall 90, and friction wall 170 presses against flanges 74. Head 154 of rivet 136 is recessed in shoe 140 so that the head does not contact wall 90. Bearing collar 188 receives arm 98. Opening 176 holds rivet 136, and rivet sleeve 138 which includes upper spring guide 130 and lower spring guide 132. Longitudinal lip 72 strengthens flange 74, and encloses friction wall 170 in a U channel with flange 74 and wall 76 of the track.

Wall 190 of the outer friction shoe surrounds guide wall 194 of the inner friction shoe. The limit of maximum compression of shoe 108 is determined by end 208 of wall 190 and limit shoulder 204 of inner friction shoe 146 when they meet.

Shoe 108 provides a constant friction between the shoe and the track as it travels within the track. The friction is sufficient to overcome the thrust along the track imparted by arm 98 to the shoe, which sash imparts to the arm from the natural tendency of the sash to tilt under the force of gravity. The friction permits hand tilting of the sash by an operator, and keeps the sash at whatever stage one angle of tilt that is set by the operator.

Referring to FIGS. 17–22, adjacent to and flanking each friction wall 170 is a cam 174 which engages end 212 of flange 74 at lateral opening 78 when shoe 108 is inserted in lateral opening 78 and is moved toward 216 the center of track 70. Regardless which side 218, 220, 222, or 224 is facing into track 70, a pair of cams 174 engage the flange when the shoe is pulled in direction 216 into the track by arm 98 (not shown). As the shoe enters under flanges 74, cams 174 transfer the longitudinal motion into compressive force which forces inner friction shoe 146 toward the back of the track so that it can move under flanges 74 so that it can slide in track 70.

Preferably the shape of the shoe is such that it will fit in the track by rotating to two or more positions. For example, any one of four approximately 90 degree apart positions for the square design of FIGS. 13–22, and any one of three positions for a triangular design shoe.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

I claim:

1. A hopper window comprising in combination:

a frame, a sash, said frame comprising;

a first jamb, a second jamb generally parallel to said first jamb, said first jamb comprising a longitudinal track having a first end and a second end, said sash being in said frame between said jambs, stop means mounted on said track between said first end and said second end of said track, said sash comprising a first end and a second end, and;

pivot means extending from said second end of said sash into said track, an arm pivotally attached at one end of said arm to said sash between said first end of said sash and said second end of said sash, shoe means on the other end of said arm, said shoe means being slidably mounted on said track for travel along said track between said first end of said track and said stop means, said shoe means engaging said track in generally constant resistance to said travel along said track such that said sash can be drawn by hand against said generally constant resistance to any angle from the track set by the location of said shoe means in said track between said first end of said track and said stop means, and said sash is held at said any angle by said generally constant resistance to travel of said engaging, said shoe means comprising a first wall and a second wall opposite said first wall, spring means, biasing said first wall away from said second wall, a first cam on said first wall, said first cam engaging said track for biasing said first wall toward said second wall when said shoe is mounted on said track for said sliding on said track, a second cam on said first wall, said second cam engaging said track for biasing said first wall toward said second wall when said shoe is mounted on said track for said sliding on said track. resistance to said travel along said track such that said sash.

2. The hopper window of claim 1, further comprising:

said track having a lateral opening at the first end of said track, said shoe means being removable laterally from said track at said lateral opening, and said pivot means being removable laterally from said track by tilting said sash to said track.

3. The hopper window of claim 1, further comprising:

said stop means being adjustable in location along said track.

4. The hopper window of claim 3, further comprising:

said track comprising a pair of longitudinal flanges and a longitudinal back wall, said shoe means being slidably mounted between said flanges and said back wall, and being attached to said arm between said flanges.

5. The hopper window of claim 1, further comprising:

said track adjacent to said stop on the first end side of said track being generally the same in cross section to said track adjacent to said stop on the second end side of said track.

6. The hopper window of claim 1, further comprising:

said shoe means comprising a first wall and a second wall opposite said first wall, spring means biasing said first wall away from said second wall, cam means on said first wall, said cam means engaging said track and biasing said first wall toward said second wall when said shoe means is mounted on said track for said sliding on said track.

7. The hopper window of claim 6, further comprising:

a friction wall on said first wall and adjacent to said cam means, said friction wall engaging said track in said generally constant resistance to travel along said track.

8. A hopper window comprising in combination:

a frame a sash,.

said frame comprising;

a first jamb, a second jamb generally parallel to said first jamb, said first jamb comprising a longitudinal track having a first end and a second end,.

said sash being in said frame between said jambs, stop means mounted on said track between said first end and said second end of said track, said sash comprising a first end and a second end, and;

pivot means extending from said second end of said sash into said track, an arm pivotally attached at one end of said arm to said sash between said first end of said sash and said second end of said sash, shoe means on the other end of said arm, said shoe means being slidably mounted on said track for travel along said track between said first end of said track and said stop means, said shoe means engaging said track in generally constant resistance to said travel along said track such that said sash can be drawn by hand against said generally constant resistance to any angle from the track set by the location of said shoe means in said track between said first end of said track and said stop means, and said sash is held at said any angle by said generally constant resistance to travel of said engaging, said shoe means comprising a first wall and a second wall opposite said first wall, spring means biasing said first wall away from said second wall, cam means on said first wall, said cam means engaging said track and biasing said first wall toward said second wall when said shoe means is mounted on said track for said sliding on said track, said first and second walls engaging said track in said generally constant resistance to travel along said track.

9. The hopper window of claim 1, further comprising:

a first longitudinal flange on said track, a second longitudinal flange on said track, said first cam engaging said first longitudinal flange, and said second cam engaging said second longitudinal flange.

10. The hopper window of claim 1, further comprising:

said shoe means comprising a first wall and a second wall, spring means biasing said first wall away from said second wall, a first cam on said first wall, a second cam on said first wall, a third cam on said first wall, two of said first, second, and third cams engaging said track, and said remaining cam of the three cams being clear of engagement with said track when said shoe means is mounted on said track.

11. A hopper window comprising in combination:

a frame, a sash, said frame comprising;

a first jamb, a second jamb generally parallel to said first jamb, said first jamb comprising a longitudinal track having a first end and a second end, said sash being in said frame between said jambs, stop means mounted on said track, being adjustable in position along said track, said sash comprising a first end and a second end, and;

pivot means extending from said second end of said sash into said track, an arm pivotally attached at one end of said arm to said sash between said first end of said sash and said second end of said sash, shoe means on the other end of said arm, said shoe means being slidably mounted on said track for travel along said track between said first end of said track and said stop means, and said pivot means being slidably mounted on said track for travel along said track between said second end of said track and said stop means.

12. The hopper window of claim 11, further comprising:

said shoe means engaging said track in generally constant resistance to said travel along said track such that said sash can be drawn by hand against said generally constant resistance to any angle from the track set by the location of said shoe means in said track between said first end of said track and said stop means, and said sash is held at said any angle by said generally constant resistance to travel of said engaging.

* * * * *

UNITED STATES PATENT AND TRADEMARK OFFICE

CERTIFICATE OF CORRECTION

PATENT NO. : 5,575,114

DATED : Nov. 19, 1996

INVENTOR(S) : Harry M. Riegelman

It is certified that error appears in the above-identified patent and that said Letters Patent is hereby corrected as shown below:

In Claim 1, column 8, line 2 of after "track.", delete "resistance to said travel along said track such that said sash."

In Claim 8, column 8, line 40 after "a sash,", delete the period ".", and column 8, line 45, after "and a second end,", delete the period ".".

Signed and Sealed this

Eighteenth Day of March, 1997

Bruce Lehman

*Attest:*

BRUCE LEHMAN

*Attesting Officer*

*Commissioner of Patents and Trademarks*